United States Patent [19]

Gorgerino

[11] Patent Number: 4,619,696

[45] Date of Patent: Oct. 28, 1986

[54] ADDITIVE FOR METALLURGICAL LIQUIDS, AND METHOD AND DEVICE FOR THE PREPARATION THEREOF

[75] Inventor: Mario D. Gorgerino, Milan, Italy

[73] Assignee: O.E.T. - Metalconsult S.r.l., Milan, Italy

[21] Appl. No.: 677,644

[22] Filed: Dec. 3, 1984

[51] Int. Cl.[4] ..... C22C 33/08

[52] U.S. Cl. ..... 75/130 R

[58] Field of Search ..... 75/130 R

[56] References Cited

U.S. PATENT DOCUMENTS 4,042,377 8/1977 Bienvenu ..... 75/130 R

*Primary Examiner*—Peter D. Rosenberg

*Attorney, Agent, or Firm*—Guido Modiano; Albert Josif

[57] ABSTRACT

An additive for metallurgical liquids is disclosed which consists of an alloy formed by admission of one or more gas phase solutes into one or more liquid phase solvents. The solvent is a substance with semiconductor characteristics, and is selected from silicon, germanium, silicon and germanium alloys with various elements for the periodic table and $A^{III}B^{V}$ and $A^{II}B^{VI}$ compounds where II,III,V, and VI are the respective groups in the periodic table. The solute is a low vapor pressure substance and is selected from lithium, sodium, potassium, magnesium, calcium, strontium, barium, zinc, cadmium, phosphorus, arsenic, antimony, bismuth, selenium, tellurium, bromine, and iodine in their elemental states or as oxides or salts thereof, in particular carbonates, chlorides, fluorides, or nitrides. The solvent and solute are used in by-weight ratios ranging from $10^{-6}$% to 99%.

Also disclosed is a method of preparing the additive for metallurgical liquids, which consists of liquefying the solvent, bringing the solute to the gas state by heat application, admitting the gasified solute into the liquefied solvent, this admission causing at least a partial dissociation of the gasified solute molecules into atoms and/or ions, and cooling the solute-enrichened solvent to obtain the additive of this invention.

Also disclosed is a device for implementing this method.

8 Claims, 2 Drawing Figures

ADDITIVE FOR METALLURGICAL LIQUIDS, AND METHOD AND DEVICE FOR THE PREPARATION THEREOF

BACKGROUND OF THE INVENTION

This invention relates to an additive for metallurgical liquids, as well as to a method and a device for the preparation thereof.

Presently available are commercial additives in alloy and flux forms. Such additives are added to metallurgical liquids for the purpose of counteracting the presence of gases and such trace elements as sulphur. The necessity of controlling and as far as possible removing gases and trace elements from metallurgical liquids is in fact generally recognized. In fact, gases are present in metallurgical liquids even as dissociated hydrogen, oxygen, or nitrogen atoms or ions in a specially reactive form which can create problems. This also applies to trace elements, and especially to sulphur.

Currently employed additives have, however, a major disadvantage in their low effectiveness to remove or counteract gases and trace elements. In fact, known additives comprise solute elements alloyed with substances acting as molecular structure solvents which are known for their low chemical activity owing to energy inertia inherent to the molecule. Thus, such additives can only counteract the presence of gases and trace elements to a limited extent and in a discontinuous way, being quite ineffective where gases take single-atom or radical-like forms.

SUMMARY OF THE INVENTION

It is a primary object of this invention to eliminate such shortcomings of known additive types, and to provide a novel type of additive which, when added to a metallurgical liquid, consents removal or drastic decrease of gases, irrespective of the structural form in which they appear, and trace elements contained therein.

Another object of the invention is to provide an additive which, when added to the metallurgical liquid, consents elimination of cold spots (inverse quenching) thanks to the extraordinary solubility of the alloys making up said additive, from metallurgical liquids, while also eliminating so-called hot spots which cause particular non-uniformity during solidification of the metallurgical liquid.

A further object of the invention is to provide a simple and effective method of preparing the additive of this invention.

Still another object of the invention is to provide a suitable device for preparing an additive as indicated.

These and other objects, such as will be apparent hereinafter, are achieved by the additive for metallurgical liquids according to the invention, which is characterized in that it comprises an alloy formed by admitting into at least one first substance (a) acting as a liquid-phase solvent at least one second substance (b) acting as a gas-phase solute, said solvent (a) having semiconductor characteristics and being selected from the group including silicon, germanium, silicon-germanium alloys, and silicon and germanium alloyed with elements from the IA,IIA,IIIA and B,IVA,VIA, VIIA and VIII groups in the periodic table and $A^{III}A^{V}$ and $B^{II}A^{VI}$ compounds, where II,III,V, and VI are the respective groups in the periodic table, said solute (b) having a high vapor pressure and being selected from lithium, sodium, potassium, magnesium, calcium, strontium, barium, zinc, cadmium, phosphorus, arsenic, antimony, bismuth, selenium, tellurium, bromine, iodine either in the state of elements or of oxides or salts thereof, the weight ratio of the solvent to the solute being in the $10^{-6}$% to 99% range.

In another aspect, this invention relates to a method of preparing an additive for metallurgical liquids, which consists of:

(i) reducing and liquefying said solvent (a) by heat application, (ii) bringing said solute (b) to the gaseous state by heat application, (iii) admitting said gasified solute into said liquefied solvent in a weight ratio of solvent to solute in the $10^{-6}$% to 99% range, so as to cause at least partial dissociation of the gasified molecules into atoms and/or ions and/or radicals.

(iv) cooling the solvent, as enrichened with the thusly dissociated particles of said solute, to obtain said additive for metallurgical liquids.

BRIEF DESCRIPTION OF THE DRAWINGS

Further features and advantages of the invention will appear more clearly from the following description, given hereby by way of illustration and not of limitation, of additives for metallurgical liquids, and of a method and a device for the preparation thereof, according to preferred embodiments of the invention, to be taken in conjunction with the accompanying drawings, where.

DESCRIPTION OF THE PREFERRED EMBODIMENTS

Figure 1:
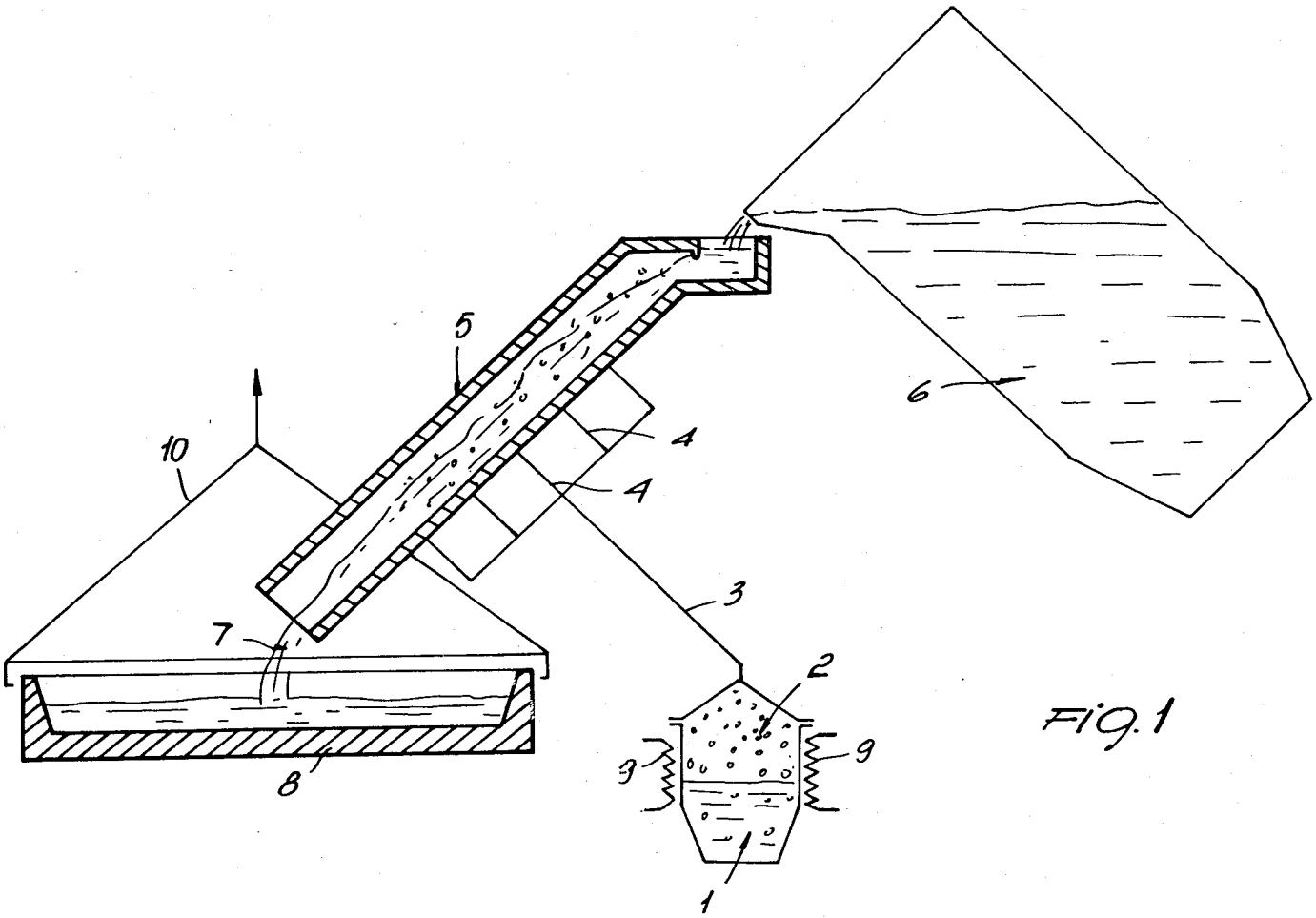
FIG. 1 is a diagramatic representation of the device for preparing the additive.

The additive according to this invention comprises, as mentioned, an alloy of a substance acting as a solvent with a second substance acting as a solute. The solvent suitable for use in this invention is selected from substances having semiconductor characteristics, mainly silicon, germanium, and their alloys wherein such characteristics are retained owing to the presence of holes or interstitial sites apt to receive and hold extraneous atoms. The solvent for use with this invention may also be selected from $A^{III}A^{V}$ and $B^{II}A^{VI}$ compounds, where Roman numbers indicate the respective groups in the periodic table. Such compounds also have semiconductor characteristics, and examples thereof, but not limited thereto, are: IIIA VA Group, wherein such compounds as aluminum-phosphorus, or aluminum-antimony have a diamond type structure wherein the solutes insert as impurities either by substitution or implantation; $B^{II}A^{VI}$ Group, wherein such compounds as zinc-tellurium or zinc-selenium have a structure with a large number of spot defects wherein the solutes insert.

Non-limitative examples of silicon and germanium alloys which may be used as solvents in the invention include iron-silicon Fe max 90%, silicon-manganese Mn max 75%, silicon-calcium-manganese Ca max 30% Mn max 30%, silicon-yttrium Y max 50, silicon germanium in any proportion, silicon calcium Ca max 33%, silicon nickel Ni max 50%, silicon aluminum Al max 60%, silicon zirconium Zr max 50%, silicon titanium Ti max 50%, silicon barium Ba max 50%, silicon chromium Cr max 65%, silicon magnesium Mg max 50%, silicon strontium Sr max 50%, silicon lanthanum and cerium, La and Ce max 50%, silicon rare earths REM max 50%, germanium iron Ge and Fe max 50%, germanium strontium Sr max 50%, germanium lanthanum La max 50%, germanium cerium Ce max 50%, germanium rare earths REM max 50%, germanium manganese Mn max 75%, germanium nickel Ni max 50%, germanium titanium Ti max 50%, etc., with any minor contents of usual alkali, alkaline earth, and transition element impurities as brought in by the raw materials and reducers.

The substances for use as solutes in the additive of this invention are selected from those having a high vapor pressure and, preferably, a particularly suitable electron molecular structure for undergoing scission, such as bromine, iodine, selenium, etc. This because, according to this invention, the solute once converted into the gaseous phase undergoes, upon admission into the liquefied solvent, the kinetic effect of the gaseous molecule impacting against the liquid solvent mass, which results in a dissociation of the molecule into atoms and ions or radicals. Such dissociated elemental particles undergo activated chemical absorption in the solvent liquid and retain that state even in the subsequent solid phase of the alloy. The presence of such active solute particles, i.e. in atom and ion or radical form held in the semiconductor structure of the solvents ensures their subsequent high activity in interacting with the gases and trace elements retained in the metallurgical liquids so as to remove them effectively.

The solute(s) is selected, for example, from the following elemental state substances: lithium, sodium, potassium, magnesium, calcium, strontium, barium, zinc, cadmium, phosphorus, arsenic, antimony, bismuth, selenium, tellurium, bromine, iodine, as well as from oxides and salts of these elements, such as carbonates, chlorides, fluorides, and nitrides.

To prepare the additive according to the invention, a broad range of solvent(s) to solute(s) ratios can be used, which may vary from $10^{-6}$% to 99% by weight.

The method and device of this invention will be now described with reference to FIG. 1. To liquefy the solvent or a mixture of compounds acting as the solvent, heating means are used, such as a reduction furnace or crucible means as indicated at 6 in the drawing.

An additional crucible 1 equipped with a heating system, for example, of the induction, preferably high frequency, type, is used to convert one or more substances acting as solutes to the gaseous phase. Already during this gasification step at least some of the solute molecules in the gaseous phase 2 are in atomized or ionized form. Means 3 of conveying or transporting the gaseous solute compounds feed, through branching lines 4, the solute in the gaseous state into a runner 5 of a refractory material.

Also fed into the runner 5 is the molten mass of solvent from the crucible 6. Collision of the gas and liquid mass in the runner causes a further substantial dissociation of the gaseous molecules into more active atomic, ionic or radical particles which are thus absorbed into the solvent. In order to ensure a more thorough dissociation of the solute a higher temperature may be used in the crucible 1 than is strictly necessary for gasification, such as to already induce, prior to the introduction into the liquid solvent, a substantial dissociation of the gaseous solute into active particles. Then the solvent containing the solute absorbed in a highly active dissociated form is allowed to solidify in an ingot mold 8. The ingot mold 8 is provided with suitable captors 10 for the pickup of deabsorption gases and reaction gases with the gases from liquid mass 7.

Alternatively, vaporization or gasification of the solutes may be provided directly in a suitably adapted ingot mold 8, by arranging the compounds acting as the solute at the bottom of same and being careful to let the solvent liquid from the runner 5 contact the solute vapors after formation of an initial solidification film at the ingot mold bottom and edges.

Also, induction of an enhanced dissociation of the solutes in gas phase can be accomplished by Roentgen rays photolysis, subsequently admitting by immersion the ionized gases directly to the interior of the solvent liquid.

The examples which follow are given for illustrative purposes only so as to make possible embodiments of this invention more clearly understood.

EXAMPLE 1

Preparation of the invention additive

As a solute, a mixture of selenium-bromineiodine is used, which is gasified in crucible 1 by heating to a temperature of 1,000° C. by induction heating of a frequency of 20 kHz. As a solvent in crucible 6, a commercial iron silicon alloy is used which contains 75% silicon, 0.03% aluminum, 0.01% calcium, and the remainder iron. Liquefaction of the solvent was performed at a casting temperature of about 1,700° C. using a reduction furnace as a heat source. A solute to solvent proportion of 0.50/100 by weight has been used. After the admission of selenium-bromine-iodine vapors into the liquid solvent flowing through runner 5, an alloy was obtained on cooling in the ingot mold 8 which was used as an additive for metallurgical liquids as shown herein below. The additive of this Example, and more generally the additives of this invention, are added to metallurgical liquids in amounts of 0.001% to 7% of the weight of the metallurgical liquid.

Several tests have been carried out by adding the additive of this invention into nodular cast iron, hypoeutectic cast iron, ipereutectic and low-alloy cast iron, and Ni Resist, and steel for thin wire rod. The choice of the entire range of cast irons was dictated both by the fact that it undergoes no degassing treatment in the course of processing, so that the hydrogen and oxygen content in the liquid remain high, and by the fact that the founder desires when feasible to obtain certain structures upon solidification, without resorting to heat treatments.

All test were carried out on an industrial scale using cast iron processed in an induction furnace operating at mains electric frequency.

All of the various alloys produced yielded substantially uniform results, mainly on account of the inventive chemical absorption process providing a uniform activity of the additive as a consequence of the particular chemical and physical location that the solute element group takes in the solvent volume.

EXAMPLE 2

Tests on cast iron

The tests were carried out on a crankshaft tending to develop pin-holing on the initial solidification side, opposite to pouring head.

Figure 2:
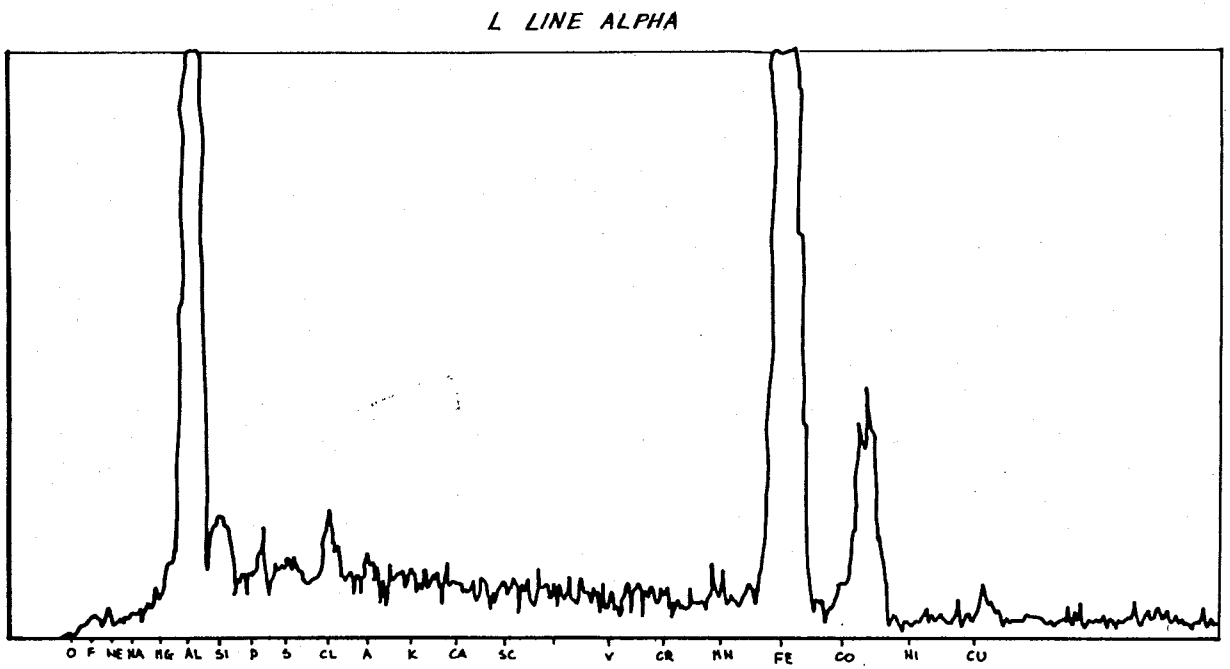
FIG. 2 is a qualitative SEM (Scanning Electron Microscope) analysis graph for a number of conventional cast iron samples produced without the additive of the invention.

Several conventional current production samples were previously studied which during the processing stage had shown extensive pinholing. Assuming that any reaction that develops, leaves in the reaction site a trace of the elements that bring it about, the pinholed cones were sectioned, and all of the several samples revealed aluminum peaks as shown in the graph of FIG. 2.

Of all the gases contained in cast iron, only hydrogen can react in the gas phase with aluminum, presumably to release $AlH_3$ and $Al_2H_6$ compounds.

Introducing in the mold 0.30% (as in respect of the cast iron) of Fe-Se alloy chemically absorbed with selenium-bromine-iodine, all cast crankshafts proved free of this imperfection.

Selenium combined with hydrogen in the gas phase yield the compound $H_2Se$, bromine to yield HBr and iodine to yield HI.

The use of the additive matter of this invention by inoculation into liquid cast iron of the nodular, hypoeutectic, and hyper-eutectic types has caused cementite to disappear from even the thinnest portions of the sample, thus showing that the use of the method of this invention provides the alloy, whereinto solutes are inoculated by activated chemical absorption, with semiconductor characteristics, thus bringing about a slower cooling rate of the cast iron and univocal distribution of solidification latent heat with improved hardening characteristics. With Ni Resist cast iron the diffused spongy microcavities, a frequently encountered fault with this cast iron type, disappeared completely when replacing the commercial FeSi additive with the additive according to the invention, i.e. FeSi containing SeBrI introduced by chemiabsorption. It has also been found that small amounts of the additive of this invention are adequate to substantially improve the cast characteristics, both concerning the drastic reduction in gases and trace elements, and the decrease in diffused cementite and associated hardening.

EXAMPLE 3

Tests on steel

Tests have been carried out on 32 metric tons of electric furnace melted steel for the continuous casting of billets to be then drawn into thin wire rod. The chemical characteristics required of this killed steel are: C 0.06–0.08%; Si 0.80–0.90%; Mn 1.35–1.45%.

The various steps of liquid steel oxidation were monitored with an apparatus including a Pt-Rd thermocouple and a galvanic chain, whereto the signals from these two probes are supplied and processed instrumentally to determine the activity of free oxygen. The steps were:

1. Temperature of liquid steel in the furnace: 1,752° C.; in the furnace, 598 ppm free oxygen.
2. Ladle casting; added into the latter were 10 kg Al and 600 kg SiMn; the temperature was 1,750° C.; the ladle test showed 82 ppm free oxygen.
3. Provision of two steel containers, each containing 100 kg chemical absorption-treated FeSi, activated with 0.50% BrI compound based on the iron silicon weight.
4. Introduction into the ladle of the first container; the test carried out thereafter revealed 51 ppm free oxygen.
5. 5-minute waiting time to allow turbulence to settle; the test showed 29 ppm free oxygen.
6. Introduction of the second container; the test revealed 11 ppm free oxygen.
7. The temperature of the steel in the ladle, of 1,626° C., does not consent a further residence owing to the requirements of continuous casting. Hence, no test for free oxygen can be carried out even if persistent visible reactions in the liquid steel appear indicating a further decrease in free oxygen.

I claim:

1. An additive for metallurgical liquids, in the form of an alloy comprising at least one first substance acting as a liquid phase solvent and at least one second substance acting as a gaseous phase solute, said first substance having semiconductor characteristics and being selected from the group consisting of: silicon, germanium; silicon and germanium alloyed with each other and with elements from the IA, IIA, IIIA and B, IVA, VIA, VIIA and VIII groups of the Periodic Table, and $A^{III}A^{V}$ and $B^{II}A^{VI}$ compounds, wherein II, III, V and VI are the respective groups in the Periodic Table and mixture thereof, said second substance having a high vapor pressure and being selected from the group consisting of lithium, sodium, potassium, magnesium, calcium, strontium, barium, zinc, cadmium, phosphorus, arsenic, antimony, bismuth, selenium, tellurium, bromine, iodine in the elemental state or in the state of oxides or salts thereof and mixture thereof, said second substance having at least part of the molecules thereof dissociated into atoms, ions, or radials of said molecules, the weight ratio of the first substance to the second substance being in the $10^{-6}$% to 99% range.

2. An additive according to claim 1, wherein said first substance is selected from the group consisting of alloys of iron silicon Fe max 90%, silicon manganese Mn max 75%, silicon calcium manganese Ca max 30% Mn max 30%, silicon yttrium Y max 50%, silicon germanium in any proportion, silicon calcium Ca max 33%, silicon nickel Ni max 50%, silicon aluminum Al max 60%, silicon zirconium Zr max 50%, silicon titanium Ti max 50%, silicon barium Ba max 50%, silicon chromium Cr max 65%, silicon magnesium Mg max 50%, silicon strontium Sr max 50%, silicon lanthanium cerium La and Ce max 50%; silicon rare earths REM max 50%, germanium iron Ge and Fe max 50%, germanium strontium Sr max 50%, germanium lanthanium La max 50%, germanium cerium Ce max 50%, germanium rare earths REM max 50%, germanium manganese Mn max 75%, germanium nickel Ni max 50%, germanium titanium Ti max 50%, said alloys having minor contents of ordinary alkaline, alkaline earth and of transition elements impurities originating from the raw materials and reducers.

3. An additive according to claim 1, wherein said first substance compounds $A^{III}A^{V}$ and $B^{II}A^{VI}$ are selected from the group consisting of aluminum-phosphorus and aluminum-antimony compounds which have a diamond-type structure comprising the solutes inserted therein as impurities either by substitution or by implantation, and zinc-tellurium and zinc-selenium compounds which have a structure with a large number of holes comprising the solutes inserted therein.

4. An additive according to claim 1, wherein said salts forming the second substance are selected from the group consisting of carbonates, chlorides, fluorides, nitrides and oxides of said elements.

5. A method of preparing an additive for metallurgical liquids, according to claim 1, which comprises the step of:

(i) liquefying said first substance by heat application;

(ii) bringing said second substance to a gaseous state by heat application;

(iii) causing the molecules of said second substance in the form of gasified solute (b) to dissociate at least partly into atoms, ions and/or radicals;

(iv) introducing said second substance in the form of gasified solute into said first substance in the form of liquefied solvent in a by-weight ratio of solvent to solute in the $10^{-6}$% to 99% range and (v) cooling the solvent enriched with the dissociated particles of said solute to obtain said additive for metallurgical liquids.

6. A method according to claim 5, wherein the dissociation step (iii) is carried out by using in the gasification step (ii) a sufficiently high temperature to at least partly dissociate the gasified solute molecules into atoms or ions or radicals by the effect of said heat application.

7. A method according to claim 5, wherein said dissociation step (iii) comprises subjecting said gasified solute from step (ii) to a photolysis treatment through the use of Roentgen rays to achieve dissociation at least in part of the gasified solute molecules prior to said step (iv).

8. A method according to claim 5 wherein said dissociation step (iii) is carried out by the effect of the collision, of the solute molecules against the solvent during said introduction step (iv).

* * * * *